US012296875B2

(12) United States Patent
Oh et al.

(10) Patent No.: US 12,296,875 B2
(45) Date of Patent: May 13, 2025

(54) METHOD AND APPARATUS FOR PROVIDING AUTOMATED INTERLOCKING LOGIC FOR MOVING-BLOCK RAILWAY SIGNALING

(71) Applicant: KOREA RAILROAD RESEARCH INSTITUTE, Uiwang-si (KR)

(72) Inventors: Seh Chan Oh, Suwon-si (KR); Jun Seong Park, Seoul (KR); Young Ju Kim, Hwaseong-si (KR); Rag Gyo Jeong, Seoul (KR)

(73) Assignee: KOREA RAILROAD RESEARCH INSTITUTE, Uiwang-si (KR)

( * ) Notice: Subject to any disclaimer, the term of this patent is extended or adjusted under 35 U.S.C. 154(b) by 0 days.

(21) Appl. No.: 17/916,315

(22) PCT Filed: Oct. 26, 2021

(86) PCT No.: PCT/KR2021/015131
§ 371 (c)(1),
(2) Date: Sep. 30, 2022

(87) PCT Pub. No.: WO2023/054789
PCT Pub. Date: Apr. 6, 2023

(65) Prior Publication Data

US 2024/0217567 A1 Jul. 4, 2024

(30) Foreign Application Priority Data

Sep. 30, 2021 (KR) ..... 10-2021-0130331

(51) Int. Cl.
*B61L 27/20* (2022.01)
*B61L 27/16* (2022.01)
*B61L 27/60* (2022.01)

(52) U.S. Cl.
CPC ..... *B61L 27/20* (2022.01); *B61L 27/16* (2022.01); *B61L 27/60* (2022.01)

(58) Field of Classification Search
CPC ..... B61L 27/20; B61L 27/16; B61L 27/60; B61L 27/10; B61L 27/00
See application file for complete search history.

(56) References Cited

FOREIGN PATENT DOCUMENTS

JP 2010-215157 A 9/2010
KR 10-2012-0111440 A 10/2012
(Continued)

OTHER PUBLICATIONS

Korean Office Action issued Jan. 16, 2024 in Application No. 10-2021-0130331.
(Continued)

*Primary Examiner* — Ian Jen
*Assistant Examiner* — Renee LaRose
(74) *Attorney, Agent, or Firm* — Sughrue Mion, PLLC

(57) ABSTRACT

The present disclosure provides a method and apparatus for providing an automated interlocking logic for moving-block railway signaling. According to at least one embodiment, the present disclosure provides a method for generating a train route for railway signaling based on moving block principle, including generating a directed graph for a track layout by calling pre-stored track information, generating a path matrix corresponding to the number of movement hops of a train based on the directed graph, and generating a train route from the path matrix, and verifying the train route by obtaining route information of the train from a mission of an automatic train supervision (ATS) system and comparing the route information with the train route.

10 Claims, 16 Drawing Sheets

(56) References Cited

FOREIGN PATENT DOCUMENTS

| | | | |
|---|---|---|---|
| KR | 10-2018-0015786 | A | 2/2018 |
| KR | 10-2095237 | B1 | 3/2020 |
| KR | 10-2113153 | B1 | 5/2020 |

OTHER PUBLICATIONS

Japanese Office Action issued Jan. 23, 2024 in Application No. 2022-559706.

| | C21 | C22 | P21A | C23 | P21B | C24 | C25 | P23 | P22 | C26 |
|---|---|---|---|---|---|---|---|---|---|---|
| C21 | 0 | 0 | 0 | 0 | C21+P21B | C21+P21B+C24 | 0 | C21+P21B+C24+P23 | 0 | C21+P21B+ C24+P23−C26 |
| C22 | 0 | 0 | C22+P21A | C22+P21A −C23 | C22+P21A −C23−P21B | C22+P21A− C23−P21B+C24 | C22+P21A +C25 | C22+ P21A+C23− P21B+C24+P23 | C22+P21A +C25+P22 | C22+P21A−C23 −P21B+C24 +P23−C26 |
| P21A | 0 | P21A+C22 | 0 | P21A−C23 | P21A−C23 −P21B | P21A−C23− P21B+C24 | P21A+C25 | P21A+C23−P21B +C24+P23 | P21A+C25 +P22 | P21A−C23−P21B +C24+P23−C26 |
| C23 | 0 | C23−P21A+C22 | C23−P21A | 0 | C23−P21B | C23−P21B+C24 | 0 | C23−P21B+ C24+P23 | 0 | C23−P21B+ C24+P23−C26 |
| P21B | P21B+C21 | P21B−C23− P21A+C22 | P21B+C23 +P21A | P21B−C23 | 0 | P21B+C24 | 0 | P21B+C24+P23 | 0 | P21B+C24+ P23−C26 |
| C24 | C24+P21B+C21 | C24+P21B− C23−P21A+C22 | C24+P21B− C23−P21A | C24P+P21B−C23 | C24+P21B | 0 | 0 | C24+P23 | 0 | C24+P23−C26 |
| C25 | 0 | C25+P21A+C22 | 0 | 0 | 0 | 0 | 0 | 0 | C25+P22 | 0 |
| P23 | P23+C24+ P21B+C21 | P23+C24+ P21B+C23 −P21A+C22 | P23+C24+P21B −C23−P21A | P23+C24 +P21B−C23 | P23+C24+P21B | P23+C24 | 0 | 0 | 0 | P23−C26 |
| P22 | 0 | 0 | P22+C25+P21A | 0 | 0 | 0 | P22+C25 | 0 | 0 | 0 |
| C26 | C26−P23+C24 +P21+C21 | C26−P23+C24 +P21B−C23− P21A+C22 | C26−P23+C24 +P21B−C23 −P21A | C26−P23+C24 +P21B−C23 | C26−P23+ C24+P21B | C26−P23+C24 | 0 | C26−P23 | 0 | 0 |

{Graph $G_n$}

{Graph $G_r$}

*FIG. 9A*

{Graph $G_n$}

P(<C21,C22>,<C28−C33>)

| | C27 | P25 | P24 | C28 | C29 | C30 | C31 | C32 | C33 |
|---|---|---|---|---|---|---|---|---|---|
| C21 | 0 | C21+P21B+ C24+P23−C26+P25 | 0 | C21+P21B+ C24+P23−C26 +P25−C28 | C21+P21B+ C24+P23−C26 +P25+C29 | C21+P21B+ C24+P23+C30 | 0 | 0 | 0 |
| C22 | C22+P21A C25+P22 −C27 | C22+P21A−C23 −P21B+C24+ P23−C26 +P25 | C22+P21A+ C25+P22 −C27+P24 | C22+P21A−C23− P21B+C24+P23 −C26+P25−C28 | C22+P21A−C23− P21B+C24+P23 −C26+P25+C29 | C22+P21A− C23+P21B+C24 +P23+C30 | C22+P21A +C25+P22 +C31 | C22+P21A+C25 +P22−C27 +P24+C32 | C22+P21A+C25 +P22+C27 +P24−C33 |
| P21A | P21A+C25 +P22−C27 | P21A−C23−P21B +C24+P23 −C26+P25 | P21A+C25+ P22−C27+P24 | P21A−C23− P21B+C24+P23 −C26+P25−C28 | P21A−C23−P21B +C24+P23−C26 +P25+C29 | P21A−C23+ P21B+C24 +P23+C30 | P21A+C25 +P22+C31 | P21A+C25 +P22−C27 +P24+C32 | P21A+C25 +P22+C27 +P24−C33 |
| C23 | 0 | C23−P21B+C24 +P23−C26+P25 | 0 | C23−P21B+C24 +P23−C26 +P25−C28 | C23−P21B+C24 +P23−C26 +P25+C29 | C23+P21B+C24 +P23+C30 | 0 | 0 | 0 |
| P21B | 0 | P21B+C24+P23 −C26+P25 | 0 | P21B+C24+ P23−C26+ P25−C28 | P21B+C24+P23− C26+P25+C29 | P21B+C24+ P23+C30 | 0 | 0 | 0 |
| C24 | 0 | C24+P23− C26+P25 | 0 | C24+P23−C26 +P25−C28 | C24+P23+C26 +P25+C29 | C24 +P23+C30 | 0 | 0 | 0 |
| C25 | C25+P22−C27 | 0 | C25+P22− C27+P24 | 0 | 0 | 0 | C25+P22+C31 | C25+P22−C27 +P24+C32 | C25+P22+C27 +P24−C33 |
| P23 | 0 | P23−C26+P25 | 0 | P23−C26+ P25−C28 | P23−C26+ P25+C29 | P23+C30 | 0 | 0 | 0 |
| P22 | P22−C27 | 0 | P22−C27+P24 | 0 | 0 | 0 | P22+C31 | P22−C27+ P24+C32 | P22+C27+ P24−C33 |
| C26 | 0 | C26+P25 | 0 | C26+P25−C28 | C26+P25+C29 | 0 | 0 | 0 | 0 |

*FIG. 9B*

{Graph $G_n$}

| | C21 | C22 | P21A | C23 | P21B | C24 | C25 | P23 | P22 | C26 |
|---|---|---|---|---|---|---|---|---|---|---|
| C27 | 0 | C27−P22+C25 +P21A+C22 | C27−P22 +C25+P21A | 0 | 0 | 0 | C27−P22+C25 | 0 | C27−P22 | 0 |
| P25 | P25+C26− P23+C24+ P21B+C21 | P25+C26−P23+ C24+P21B−C23 −P21A+C22 | P25+C26−P23 +C24+P21B −C23−P21A | P25+C26− P23+C24+ P21B−C23 | P25+C26−P23 +C24+P21B | P25+C26 −P23+C24 | 0 | P23−C26+P25 | 0 | P25+C26 |
| P24 | 0 | P24+C27−P22 +C25+P21A +C22 | P24+C27−P22 +C25+P21A | 0 | 0 | 0 | P24+C27 −P22+C25 | 0 | P24+C27−P22 | 0 |
| C28 | C28−P25+C26 −P23+C24+ P21B+C21 | C28−P25+C26 −P23+C24+P21B −C23−P21A+C22 | C28−P25+C26 −P23+C24+P21B −C23−P21A | C28−P25+C26 −P23+C24+ P21B−C23 | C28−P25+C26− P23+C24+P21B | C28−P25+C26 −P23+C24 | 0 | C28−P25+C26−P23 | 0 | C28−P25+C26 |
| C29 | C29+P25+C26 −P23+C24+ P21B+C21 | C29+P25+C26 −P23+C24+P21B −C23−P21A+C22 | C29+P25+C26 −P23+C24+P21B −C23−P21A | C29+P25+C26 −P23+C24+ P21B−C23 | C29+P25+C26− P23+C24+P21B | C29+P25+C26 −P23+C24 | 0 | C29+P25+C26−P23 | 0 | C29+P25+C26 |
| C30 | C30+P23+C24 +P21B+C21 | C30+P23+C24 +P21B−C23 −P21A+C22 | C30+P23+C24 +P21B−C23 −P21A | C30+P23+C24 +P21B−C23 | C30+P23+ C24+P21B | C30+P23+C24 | 0 | C30+P23 | 0 | 0 |
| C31 | 0 | C31+P22+C25+ P21A+C22 | C31+P22+C25 +P21A | 0 | 0 | 0 | C31+P22+C25 | 0 | C31+P22 | 0 |
| C32 | 0 | C32+P24+C27− P22+C25+ P21A+C22 | C32+P24+C27− P22+C25+P21A | 0 | 0 | 0 | C32+P24+C27 −P22+C25 | 0 | C32+P24+C27−P22 | 0 |
| C33 | 0 | C33−P24+C27− P22+C25+ P21A+C22 | C33−P24+C27− P22+C25+P21A | 0 | 0 | 0 | C33−P24+C27 −P22+C25 | 0 | C33−P24+C27−P22 | 0 |

P(<C28~C33>,<C21,C22>)

*FIG. 9C*

| | C27 | P25 | P24 | C28 | C29 | C30 | C31 | C32 | C33 |
|---|---|---|---|---|---|---|---|---|---|
| C27 | 0 | 0 | C27+P24 | 0 | 0 | 0 | 0 | C27+P24+C32 | C27+P24−C33 |
| P25 | 0 | 0 | 0 | P25−C28 | P25+C29 | 0 | 0 | 0 | 0 |
| P24 | P24+P27 | 0 | 0 | 0 | 0 | 0 | 0 | P24+C32 | P24−C33 |
| C28 | 0 | C28−P25 | 0 | 0 | 0 | 0 | 0 | 0 | 0 |
| C29 | 0 | C29+P25 | 0 | 0 | 0 | 0 | 0 | 0 | 0 |
| C30 | 0 | 0 | 0 | 0 | 0 | 0 | 0 | 0 | 0 |
| C31 | 0 | 0 | 0 | 0 | 0 | 0 | 0 | 0 | 0 |
| C32 | C32+P24+C27 | 0 | C32+P24 | 0 | 0 | 0 | 0 | 0 | 0 |
| C33 | C33−P24+C27 | 0 | C33−P24 | 0 | 0 | 0 | 0 | 0 | 0 |

{Graph $G_n$}

{Graph $G_r$}

FIG. 9D

FIG. 11

$$C = \begin{array}{c} \\ C21 \\ C22 \\ P21A \\ C23 \\ P21B \\ C24 \\ C25 \\ P23 \\ P22 \\ C26 \\ C27 \\ P25 \\ P24 \\ C28 \\ C29 \\ C30 \\ C31 \\ C32 \\ C33 \end{array} \begin{array}{c} \begin{array}{ccccccccccccccccccccc} C21 & C22 & P21A & C23 & P21B & C24 & C25 & P23 & P22 & C26 & C27 & P25 & P24 & C28 & C29 & C30 & C31 & C32 & C33 \end{array} \\ \begin{bmatrix} C21 & 0 & 0 & 0 & 0 & 0 & 0 & 0 & 0 & 0 & 0 & 0 & 0 & 0 & 0 & 0 & 0 & 0 & 0 \\ 0 & C22 & 0 & 0 & 0 & 0 & 0 & 0 & 0 & 0 & 0 & 0 & 0 & 0 & 0 & 0 & 0 & 0 & 0 \\ 0 & 0 & P21A & 0 & 0 & 0 & 0 & 0 & 0 & 0 & 0 & 0 & 0 & 0 & 0 & 0 & 0 & 0 & 0 \\ 0 & 0 & 0 & C23 & 0 & 0 & 0 & 0 & 0 & 0 & 0 & 0 & 0 & 0 & 0 & 0 & 0 & 0 & 0 \\ 0 & 0 & 0 & 0 & P21B & 0 & 0 & 0 & 0 & 0 & 0 & 0 & 0 & 0 & 0 & 0 & 0 & 0 & 0 \\ 0 & 0 & 0 & 0 & 0 & C24 & 0 & 0 & 0 & 0 & 0 & 0 & 0 & 0 & 0 & 0 & 0 & 0 & 0 \\ 0 & 0 & 0 & 0 & 0 & 0 & C25 & 0 & 0 & 0 & 0 & 0 & 0 & 0 & 0 & 0 & 0 & 0 & 0 \\ 0 & 0 & 0 & 0 & 0 & 0 & 0 & P23 & 0 & 0 & 0 & 0 & 0 & 0 & 0 & 0 & 0 & 0 & 0 \\ 0 & 0 & 0 & 0 & 0 & 0 & 0 & 0 & P22 & 0 & 0 & 0 & 0 & 0 & 0 & 0 & 0 & 0 & 0 \\ 0 & 0 & 0 & 0 & 0 & 0 & 0 & 0 & 0 & C26 & 0 & 0 & 0 & 0 & 0 & 0 & 0 & 0 & 0 \\ 0 & 0 & 0 & 0 & 0 & 0 & 0 & 0 & 0 & 0 & C27 & 0 & 0 & 0 & 0 & 0 & 0 & 0 & 0 \\ 0 & 0 & 0 & 0 & 0 & 0 & 0 & 0 & 0 & 0 & 0 & P25 & 0 & 0 & 0 & 0 & 0 & 0 & 0 \\ 0 & 0 & 0 & 0 & 0 & 0 & 0 & 0 & 0 & 0 & 0 & 0 & P24 & 0 & 0 & 0 & 0 & 0 & 0 \\ 0 & 0 & 0 & 0 & 0 & 0 & 0 & 0 & 0 & 0 & 0 & 0 & 0 & C28 & 0 & 0 & 0 & 0 & 0 \\ 0 & 0 & 0 & 0 & 0 & 0 & 0 & 0 & 0 & 0 & 0 & 0 & 0 & 0 & C29 & 0 & 0 & 0 & 0 \\ 0 & 0 & 0 & 0 & 0 & 0 & 0 & 0 & 0 & 0 & 0 & 0 & 0 & 0 & 0 & C30 & 0 & 0 & 0 \\ 0 & 0 & 0 & 0 & 0 & 0 & 0 & 0 & 0 & 0 & 0 & 0 & 0 & 0 & 0 & 0 & C31 & 0 & 0 \\ 0 & 0 & 0 & 0 & 0 & 0 & 0 & 0 & 0 & 0 & 0 & 0 & 0 & 0 & 0 & 0 & 0 & C32 & 0 \\ 0 & 0 & 0 & 0 & 0 & 0 & 0 & 0 & 0 & 0 & 0 & 0 & 0 & 0 & 0 & 0 & 0 & 0 & C33 \end{bmatrix} \end{array}$$

FIG. 12

$$R_n = \begin{array}{c} \\ C21 \\ C22 \\ P21A \\ C23 \\ P21B \\ C24 \\ C25 \\ P23 \\ P22 \\ C26 \\ C27 \\ P25 \\ P24 \\ C28 \\ C29 \\ C30 \\ C31 \\ C32 \\ C33 \end{array} \begin{array}{c} \begin{array}{ccccccccccccccccccccc} C21 & C22 & P21A & C23 & P21B & C24 & C25 & P23 & P22 & C26 & C27 & P25 & P24 & C28 & C29 & C30 & C31 & C32 & C33 \end{array} \\ \begin{bmatrix} 0 & 0 & 0 & 0 & + & 0 & 0 & 0 & 0 & 0 & 0 & 0 & 0 & 0 & 0 & 0 & 0 & 0 & 0 \\ 0 & 0 & + & 0 & 0 & 0 & 0 & 0 & 0 & 0 & 0 & 0 & 0 & 0 & 0 & 0 & 0 & 0 & 0 \\ 0 & 0 & 0 & - & 0 & 0 & + & 0 & 0 & 0 & 0 & 0 & 0 & 0 & 0 & 0 & 0 & 0 & 0 \\ 0 & 0 & 0 & 0 & - & 0 & 0 & 0 & 0 & 0 & 0 & 0 & 0 & 0 & 0 & 0 & 0 & 0 & 0 \\ 0 & 0 & 0 & 0 & 0 & + & 0 & 0 & 0 & 0 & 0 & 0 & 0 & 0 & 0 & 0 & 0 & 0 & 0 \\ 0 & 0 & 0 & 0 & 0 & 0 & 0 & + & 0 & 0 & 0 & 0 & 0 & 0 & 0 & 0 & 0 & 0 & 0 \\ 0 & 0 & 0 & 0 & 0 & 0 & 0 & 0 & + & 0 & 0 & 0 & 0 & 0 & 0 & 0 & 0 & 0 & 0 \\ 0 & 0 & 0 & 0 & 0 & 0 & 0 & 0 & 0 & - & 0 & 0 & 0 & 0 & 0 & + & 0 & 0 & 0 \\ 0 & 0 & 0 & 0 & 0 & 0 & 0 & 0 & 0 & 0 & - & 0 & 0 & 0 & 0 & 0 & + & 0 & 0 \\ 0 & 0 & 0 & 0 & 0 & 0 & 0 & 0 & 0 & 0 & 0 & 0 & 0 & 0 & 0 & 0 & 0 & 0 & 0 \\ 0 & 0 & 0 & 0 & 0 & 0 & 0 & 0 & 0 & 0 & 0 & 0 & + & 0 & 0 & 0 & 0 & 0 & 0 \\ 0 & 0 & 0 & 0 & 0 & 0 & 0 & 0 & 0 & 0 & 0 & 0 & 0 & - & + & 0 & 0 & 0 & 0 \\ 0 & 0 & 0 & 0 & 0 & 0 & 0 & 0 & 0 & 0 & 0 & 0 & 0 & 0 & 0 & 0 & 0 & + & - \\ 0 & 0 & 0 & 0 & 0 & 0 & 0 & 0 & 0 & 0 & 0 & 0 & 0 & 0 & 0 & 0 & 0 & 0 & 0 \\ 0 & 0 & 0 & 0 & 0 & 0 & 0 & 0 & 0 & 0 & 0 & 0 & 0 & 0 & 0 & 0 & 0 & 0 & 0 \\ 0 & 0 & 0 & 0 & 0 & 0 & 0 & 0 & 0 & 0 & 0 & 0 & 0 & 0 & 0 & 0 & 0 & 0 & 0 \\ 0 & 0 & 0 & 0 & 0 & 0 & 0 & 0 & 0 & 0 & 0 & 0 & 0 & 0 & 0 & 0 & 0 & 0 & 0 \\ 0 & 0 & 0 & 0 & 0 & 0 & 0 & 0 & 0 & 0 & 0 & 0 & 0 & 0 & 0 & 0 & 0 & 0 & 0 \\ 0 & 0 & 0 & 0 & 0 & 0 & 0 & 0 & 0 & 0 & 0 & 0 & 0 & 0 & 0 & 0 & 0 & 0 & 0 \end{bmatrix} \end{array}$$

FIG. 13

$$R_r = \begin{array}{c} \\ C21 \\ C22 \\ P21A \\ C23 \\ P21B \\ C24 \\ C25 \\ P23 \\ P22 \\ C26 \\ C27 \\ P25 \\ P24 \\ C28 \\ C29 \\ C30 \\ C31 \\ C32 \\ C33 \end{array} \begin{array}{c} \begin{array}{ccccccccccccccccccc} C21 & C22 & P21A & C23 & P21B & C24 & C25 & P23 & P22 & C26 & C27 & P25 & P24 & C28 & C29 & C30 & C31 & C32 & C33 \end{array} \\ \begin{bmatrix} 0 & 0 & 0 & 0 & 0 & 0 & 0 & 0 & 0 & 0 & 0 & 0 & 0 & 0 & 0 & 0 & 0 & 0 & 0 \\ 0 & 0 & 0 & 0 & 0 & 0 & 0 & 0 & 0 & 0 & 0 & 0 & 0 & 0 & 0 & 0 & 0 & 0 & 0 \\ 0 & + & 0 & 0 & 0 & 0 & 0 & 0 & 0 & 0 & 0 & 0 & 0 & 0 & 0 & 0 & 0 & 0 & 0 \\ 0 & 0 & - & 0 & 0 & 0 & 0 & 0 & 0 & 0 & 0 & 0 & 0 & 0 & 0 & 0 & 0 & 0 & 0 \\ + & 0 & 0 & - & 0 & 0 & 0 & 0 & 0 & 0 & 0 & 0 & 0 & 0 & 0 & 0 & 0 & 0 & 0 \\ 0 & 0 & 0 & 0 & + & 0 & 0 & 0 & 0 & 0 & 0 & 0 & 0 & 0 & 0 & 0 & 0 & 0 & 0 \\ 0 & 0 & + & 0 & 0 & 0 & 0 & 0 & 0 & 0 & 0 & 0 & 0 & 0 & 0 & 0 & 0 & 0 & 0 \\ 0 & 0 & 0 & 0 & 0 & + & 0 & 0 & 0 & 0 & 0 & 0 & 0 & 0 & 0 & 0 & 0 & 0 & 0 \\ 0 & 0 & 0 & 0 & 0 & 0 & + & 0 & 0 & 0 & 0 & 0 & 0 & 0 & 0 & 0 & 0 & 0 & 0 \\ 0 & 0 & 0 & 0 & 0 & 0 & 0 & - & 0 & 0 & 0 & 0 & 0 & 0 & 0 & 0 & 0 & 0 & 0 \\ 0 & 0 & 0 & 0 & 0 & 0 & 0 & 0 & - & 0 & 0 & 0 & 0 & 0 & 0 & 0 & 0 & 0 & 0 \\ 0 & 0 & 0 & 0 & 0 & 0 & 0 & 0 & 0 & + & 0 & 0 & 0 & 0 & 0 & 0 & 0 & 0 & 0 \\ 0 & 0 & 0 & 0 & 0 & 0 & 0 & 0 & 0 & 0 & + & 0 & 0 & 0 & 0 & 0 & 0 & 0 & 0 \\ 0 & 0 & 0 & 0 & 0 & 0 & 0 & 0 & 0 & 0 & 0 & - & 0 & 0 & 0 & 0 & 0 & 0 & 0 \\ 0 & 0 & 0 & 0 & 0 & 0 & 0 & 0 & 0 & 0 & 0 & + & 0 & 0 & 0 & 0 & 0 & 0 & 0 \\ 0 & 0 & 0 & 0 & 0 & 0 & 0 & + & 0 & 0 & 0 & 0 & 0 & 0 & 0 & 0 & 0 & 0 & 0 \\ 0 & 0 & 0 & 0 & 0 & 0 & 0 & 0 & + & 0 & 0 & 0 & 0 & 0 & 0 & 0 & 0 & 0 & 0 \\ 0 & 0 & 0 & 0 & 0 & 0 & 0 & 0 & 0 & 0 & 0 & 0 & + & 0 & 0 & 0 & 0 & 0 & 0 \\ 0 & 0 & 0 & 0 & 0 & 0 & 0 & 0 & 0 & 0 & 0 & 0 & - & 0 & 0 & 0 & 0 & 0 & 0 \end{bmatrix} \end{array}$$

METHOD AND APPARATUS FOR PROVIDING AUTOMATED INTERLOCKING LOGIC FOR MOVING-BLOCK RAILWAY SIGNALING

CROSS REFERENCE TO RELATED APPLICATIONS

This application is a National Stage of International Application No. PCT/KR2021/015131 filed Oct. 26, 2021, claiming priority based on Korean Patent Application No. 10-2021-0130331 filed Sep. 30, 2021.

TECHNICAL FIELD

The present disclosure in some embodiments relates to a method and apparatus for providing an automated interlocking logic for moving-block railway signaling.

BACKGROUND

The statements in this section merely provide background information related to the present disclosure and do not necessarily constitute prior art.

In the technical field of the railway signaling system, the fixed block principle has a drawback in that it can only grasp location information of a train by the device installed on the track disabling the real-time train location to be accurately determined. To remedy the situation with the fixed block principle, a railway signaling system of the moving block principle is being studied. However, the conventional moving block-based automatic train control (ATC) is currently implemented as an added layer onto the fixed block-based interlocking as shown in FIG. 1. Additionally, system requirements of IEEE 1474.3 and ETCS subset 026, which are standards for Communication Based Train Control (CBTC) and European Train Control System (ETCS) based on the conventional moving block principle, are regarding the interlocking as an external system, just defining the interface of interlocking. The structural limitations of the currently disclosed ATC increase the complexity of the system and lower the control efficiency of the moving block train control system. Accordingly, there is a need for a moving block ATC capable of increasing the track capacity by allowing a plurality of trains in a single block or single route.

FIG. 2 illustrates trains T1 and T2 traveling from point A and point D, respectively. Point machines P1 and P2 may change the traveling direction of the trains by performing direction switching. A switching area is indicated in FIG. 2 by dotted lines with points A, B, D, and E as boundaries. When train T1 is on a preset schedule to depart from point A and go through point machine P1 and pass point B, point machine P1 operates in a normal mode. The operation of point machine P1 generates a route [A, P1, B] for train T1. When train T2 is scheduled to depart from point D and pass point B via point C, both point machines P1 and P2 must operate in reverse mode. This requires a route of [D, P2, C, P1, B] to be generated for train T2. However, the conventional interlocking system blocks the route of train T2 so that train T2 does not enter the switching area until the tail of train T1 completely leaves point B. In other words, since the route provided by the conventional interlocking system is based on a fixed-block interlocking logic, there is a persistent issue of decreased use efficiency of track resources and decreased efficiency of the moving block ATC. Therefore, new interlocking logic for moving block environment is needed.

An interlocking system serves to perform exclusive resource distribution of a switching area by utilizing an interlocking logic in generating a route of the train traveling on the track. Multiple routes of trains generated by the interlocking system need to not overlap with each other to prevent collisions with other trains existing within the jurisdiction. In other words, there should be no other trains in the generated route of the train. Additionally, direction switching by a point machine (PM) located on the route generated by the interlocking system needs to be performed accurately and safely according to a preset schedule. The interlocking system cannot grasp the running condition of the train in real-time, except for the track occupation information of the running train. Therefore, the conventional interlocking system requires complex interlocking logic to generate a safe route of the train based on limited information. The interlocking logic can be defined by a protection logic constructed using only fixed block track occupation information of the train. The protection logic may be designed for a plurality of situations and may be, for example, a logic related to the occupation of an exclusive resource and control of a signal apparatus and a point machine. The interlocking system cannot know precisely whether a train is moving within a track or not. Therefore, the interlocking system is adapted to count the track movement time for determining whether the train moves from one track to another within a predetermined time. On the other hand, since the interlocking system cannot check the running speed of the train and protect the same, it cannot be guaranteed that the train will necessarily stop within the route. Therefore, the interlocking system locks in place the point machine when located outside the route, along with the train to protect the train against derailment. This operation logic is called overlap locking. The interlocking system performs unlocking normally after the train has not moved within the arrival track for 60 seconds.

FIG. 3 illustrates that the interlocking logic of the conventional interlocking system involving complex protection logic is functionally redundant when it is combined with a moving block zone controller (ZC). The interlocking logic of the interlocking system controls the route of a particular train and thereby exclusively secures the track section including the switching area in the jurisdiction. In other words, the interlocking system allocates track resources so that there are no other trains on the train's route. The ZC also exclusively secures track sections by granting movement authority (MA) to the particular train. In other words, ZC allocates the track resources so that no other trains are included in the movement authority granted to the train. Since ZC receives the generated route and provides movement authority to the trains included on the route, it cannot render the moving block to take effect. As described above, the interlocking logic and the ZC perform the same exclusive resource allocation function. Therefore, the interlocking logic for the moving block can further simplify the design of the system through a verification of the switching direction for accurately and safely performing the direction switching of the point machine in the switching area.

DISCLOSURE

Technical Problem

The present disclosure in some embodiments seeks to provide an apparatus and method for generating a train route for a moving block railway signaling system.

According to another aspect, the present disclosure seeks to provide a technology that can simplify the structure of a moving block railway signaling system.

According to yet another aspect, the present disclosure seeks to provide a technique for efficiently controlling an interval between trains in a switching area.

SUMMARY

At least one aspect of the present disclosure provides a method for generating a train route for railway signaling based on a moving block, including generating a directed graph for a track layout by calling pre-stored track information, generating a path matrix corresponding to the number of movement hops of a train based on the directed graph, and generating a train route from the path matrix, and verifying the train route by obtaining route information of the train from a mission of an automatic train supervision (ATS) system and comparing the route information with the train route.

According to another embodiment, the present disclosure provides an apparatus for generating a train route, including a database, a communication module, and a processor. The processor is configured to generate a directed graph for a track layout by calling pre-stored track information, to generate a path matrix corresponding to the number of movement hops of the train based on the directed graph, and generate a train route from the path matrix, and to verify the train route by obtaining route information of the train from a mission of an automatic train supervision (ATS) system and comparing the route information with the train route.

According to yet another embodiment, the present disclosure provides a computer program stored in a computer-readable medium for executing the steps respectively included in the method for generating a train route.

Advantageous Effects

As described above, the present disclosure in at least one embodiment dynamically searches all possible paths by using a graph-based operation, which enables verification of a safe route.

According to another embodiment, the present disclosure implements a complete moving-block railway signaling system, allowing to simplify the system structure.

According to yet another embodiment, the present disclosure can efficiently control the distance between trains in a switching area.

According to yet another embodiment, the present disclosure can contribute to the flexibility and scalability of the system by the automated interlocking logic.

BRIEF DESCRIPTION OF THE DRAWINGS

FIGS. 9A, 9B, 9C, and 9D illustrate final routing matrices generated by the train-route generating apparatus according to at least one embodiment of the present disclosure.

FIG. 11 illustrates an Equation 11.

FIG. 12 illustrates an Equation 12.

FIG. 13 illustrates an Equation 13.

DETAILED DESCRIPTION

Figure 1:
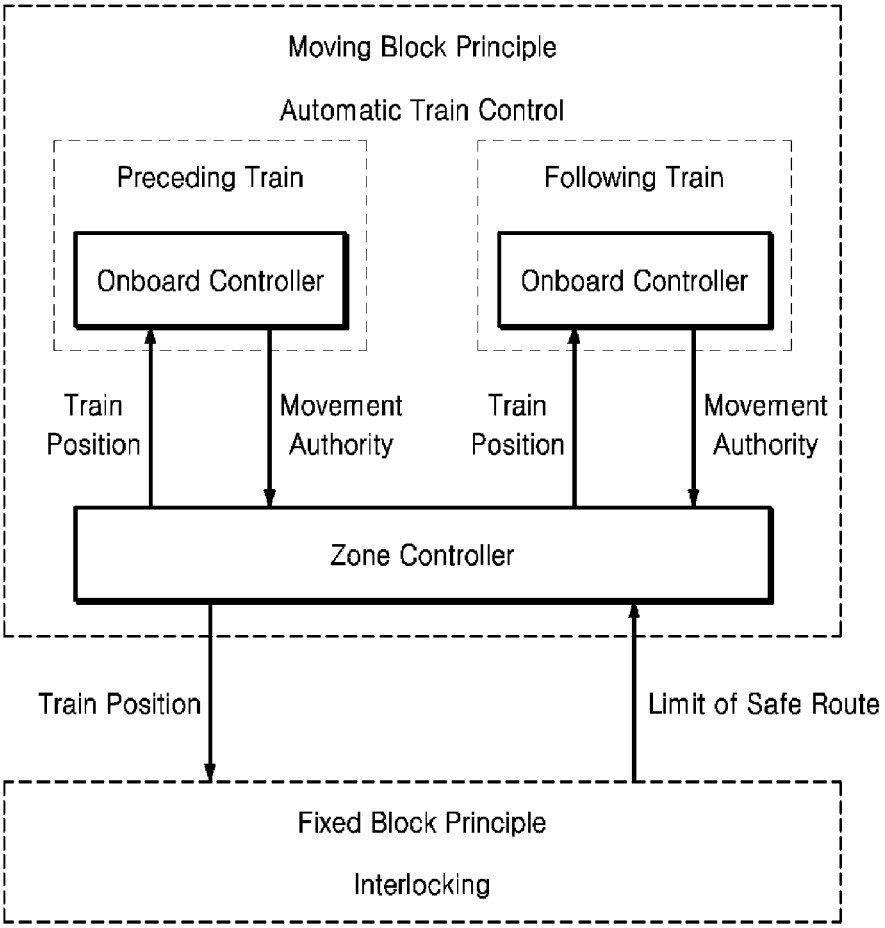
FIG. 1 (Prior Art)
FIG. 1 is a block diagram for illustrating a conventional moving block-based ATC implemented as an additional layer on a fixed block-based interlocking system.

Hereinafter, some embodiments of the present disclosure will be described in detail with reference to the accompanying drawings. In the following description, like reference numerals preferably designate like elements, although the elements are shown in different drawings. Further, in the following description of some embodiments, a detailed description of related known components and functions when considered obscuring the subject of the present disclosure will be omitted for the purpose of clarity and for brevity.

Additionally, various terms such as first, second, A, B, (a), (b), etc., are used solely for the purpose of differentiating one component from others but not to imply or suggest the substances, the order or sequence of the components. Throughout this specification, when parts "include" or "comprise" a component, they are meant to further include other components, not excluding thereof unless there is a particular description contrary thereto. The terms such as "unit," "module," and the like refer to units for processing at least one function or operation, which may be implemented by hardware, software, or a combination thereof.

The present disclosure provides a system and method for generating interlocking logic for a moving block railway signaling system. In the moving block railway signaling system, the train route means a safe and accurate track switching direction, and the present disclosure can utilize the provided interlocking logic to generate the train route and verify the track switching direction. Additionally, the present disclosure provides an efficient interlocking logic and an efficient interlocking system for the moving block railway signaling system, thereby contributing to the simplification of the system and improvement of control efficiency of the switching area.

The interlocking logic generates a route of the train and performs the function of verifying whether the generated route is valid. The interlocking system receives the train schedule from an automatic train supervision (ATS) system and determines whether the travel paths of the train included in the train schedule are safe. The interlocking system verifies the validity of the route by checking whether the first to third conditions are satisfied. A first condition means whether there are no other trains in the generated route. A second condition means whether generated routes of a plurality of trains do not overlap each other. A third condition means whether the direction switching by the point machine existing in the train route is performed safely and accurately. An occurrence of an error in the switching direction made by the point machine could cause a catastrophic result including train derailment, collision, and rear-end collision. Therefore, route verification is an utterly important function for safety. Since ZC allocates resources exclusively by granting movement authority to trains, the first and second conditions can be integrated by the moving block railway signaling system. Therefore, the presently disclosed interlocking for the moving block system can perform the route verification by checking only the third condition. This means that the interlocking only needs to verify the integrity of the track switching direction of the point machine located in the train route, resulting in a simplified structure of the system.

The description of the present disclosure to be presented below in conjunction with the accompanying drawings is intended to describe exemplary embodiments of the present disclosure and is not intended to represent the only embodiments in which the technical idea of the present disclosure may be practiced.

Figure 4:
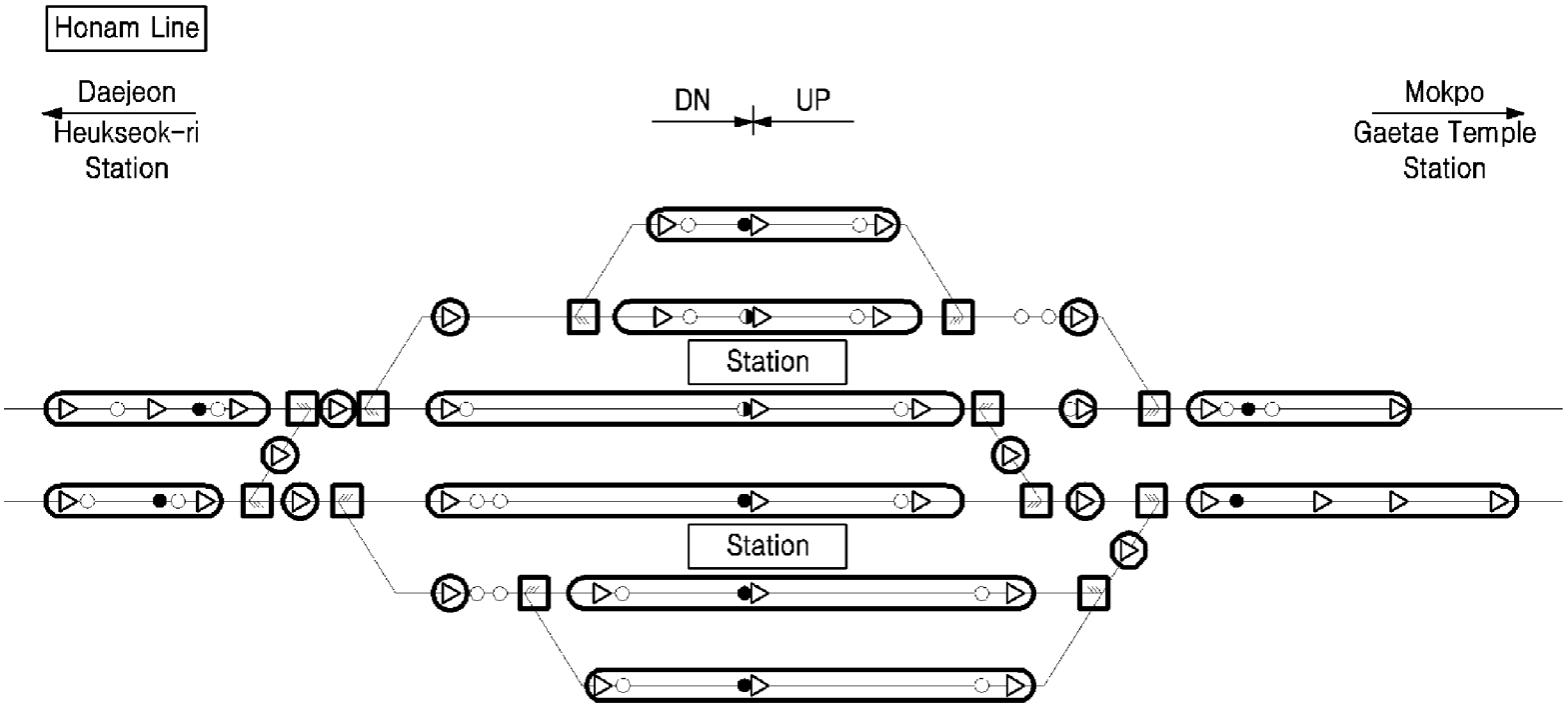
FIG. 4 illustrates configuring classes with one or more balises for generating a graph by a train-route generating apparatus according to at least one embodiment of the present disclosure.

FIG. 4 illustrates configuring classes with one or more balises for generating a graph by a train-route generating apparatus according to at least one embodiment of the present disclosure.

As shown in FIG. 4, the train-route generating apparatus defines the first to third limits to generate a graph. The first restriction is to stipulate that classes each should be composed of one or more balises or one or more tag groups. The second restriction is to stipulate that one point machine should be present between two different classes. The third restriction is to stipulate that one class should be present between two different point machines.

Figure 5:
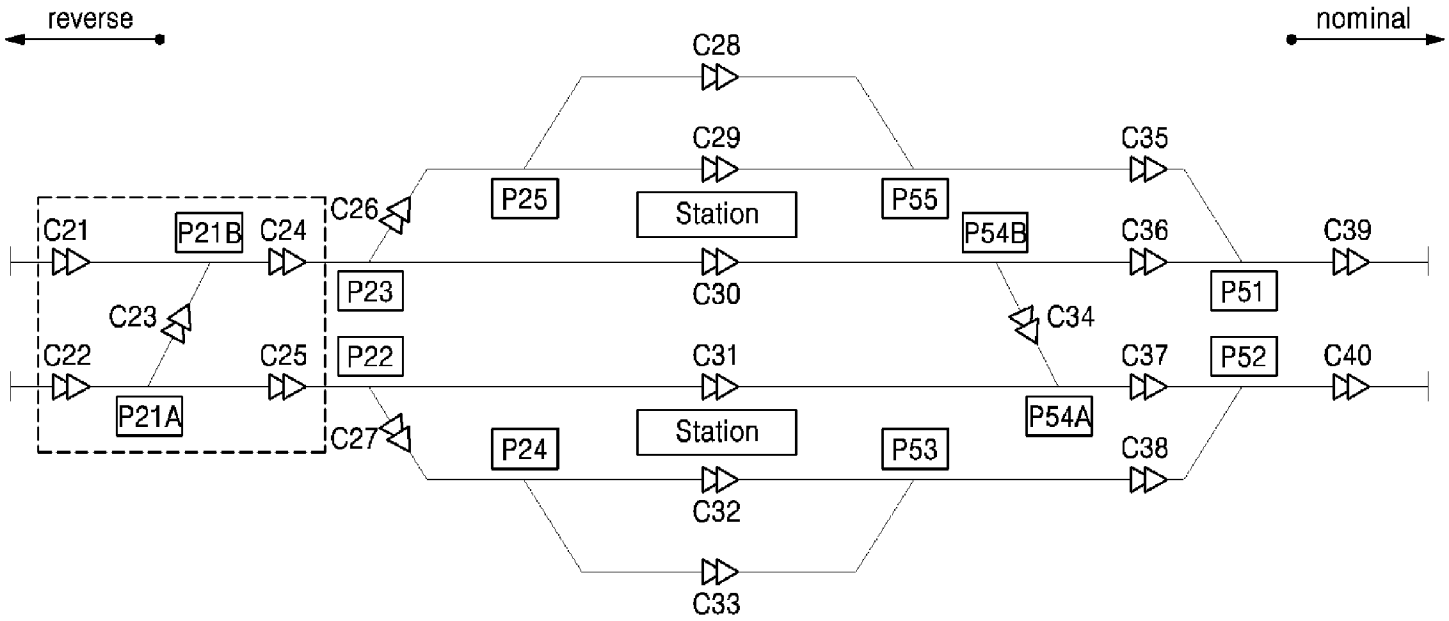
FIG. 5 illustrates an implementation of a track layout and a sub-track layout used by the train-route generating apparatus according to at least one embodiment of the present disclosure.

FIG. 5 illustrates an implementation of a track layout used by the train-route generating apparatus according to at least one embodiment of the present disclosure.

FIG. 5 shows a simplified track layout for a track map of Gyeryong Station on the Honam Line in Korea. The track layout includes a sub-track layout. As shown by the dotted lines in FIG. 5, the sub-track layout includes class 21 to class 25, point machine 21A, and point machine 21B. The interlocking function determines the track switching direction and verifies the validity of the track switching direction. The interlocking function may simplify the track layout by the classes and point machines. In FIG. 5, C denotes classes representing balises, the classes being identified by the respective numbers. P stands for point machines which are identified by the respective numbers.

Figure 6A:
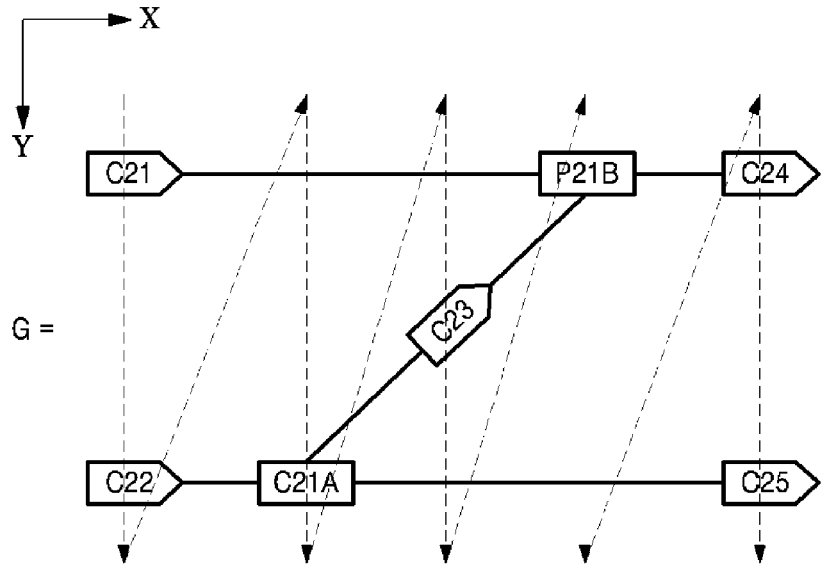
FIGS. 6A, 6B, and 6C illustrate a graph of the sub-track layout of FIG. 5, its nominal-direction graph, and its reverse-direction graph respectively.
Figure 6B:
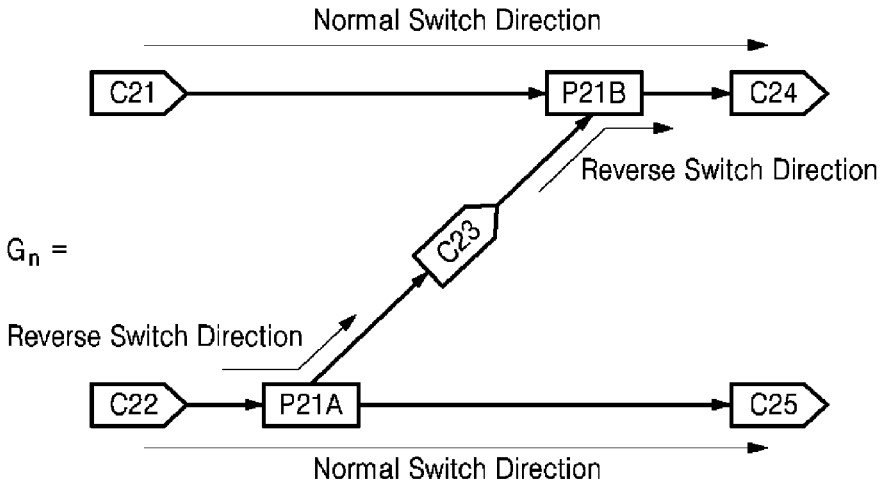
Figure 6C:
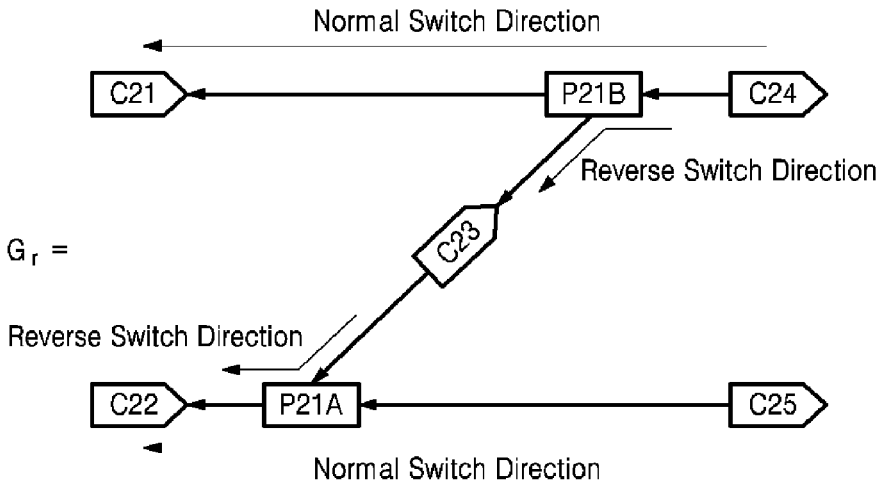

FIGS. 6A, 6B, and 6C illustrate a graph of the sub-track layout of FIG. 5, its nominal-direction graph, and its reverse-direction graph respectively.

In at least one embodiment, the present disclosure stipulates that the route generated by the railway interlocking logic be in the form of a simple path. The railway interlocking logic cannot generate the V-shapes route shown in FIG. 2 to satisfy the railway switching characteristics. The present disclosure takes into account constraints due to the railway switching characteristics and reconstructs the railway track layout in the form of a graph to generate a moving-block interlocking logic. A graph G is a pair (N, E) where N denotes nodes and E denotes edges. Here, nodes represent a set of at least one class and at least one point machine, wherein the class is composed of balise or tag group. Edges represent a set of tracks between the adjacent nodes. A nominal-direction graph Gn is a direction graph for generating a train route so that it allows at least one train running on the track to travel along the classes in ascending order of the class numbers. A reverse-direction graph Gr is a direction graph for generating a train route so that it allows at least one train running on the track to travel in descending order of the class numbers.

At least one node included in the sub-track layout of FIG. 5 may be converted into a node matrix K as expressed by Equation 1. As can be seen by referring to FIG. 6A, the elements of the node matrix K may be extracted by traversing nodes N of graph G in a zigzag direction based on the geographic location. The elements of the node matrix K are placed in each column in the order they are extracted from graph G.

$$K=[C21\ C22\ P21A\ C23\ P21B\ C24\ C25] \qquad \text{Equation 1}$$

An initial routing matrix C as expressed by Equation 2, is a two-dimensional matrix obtained by traversing the node of graph G in the zigzag direction. The initial routing matrix may be calculated by multiplying the node matrix by an identity matrix (I) having the same number of columns as those of the node matrix. The initial routing matrix becomes a diagonal matrix including a string representing the node included in graph G, as an element. The initial routing matrix is a square matrix with the same number of rows and columns and has a triangular matrix shape, featuring an easy matrix operation.

$$C = \begin{array}{c} \\ C21 \\ C22 \\ P21A \\ C23 \\ P21B \\ C24 \\ C25 \end{array} \begin{array}{c} \begin{array}{ccccccc} C21 & C22 & P21A & C23 & P21B & C24 & C25 \end{array} \\ \begin{bmatrix} C21 & 0 & 0 & 0 & 0 & 0 & 0 \\ 0 & C22 & 0 & 0 & 0 & 0 & 0 \\ 0 & 0 & P21A & 0 & 0 & 0 & 0 \\ 0 & 0 & 0 & C23 & 0 & 0 & 0 \\ 0 & 0 & 0 & 0 & P21B & 0 & 0 \\ 0 & 0 & 0 & 0 & 0 & C24 & 0 \\ 0 & 0 & 0 & 0 & 0 & 0 & C25 \end{bmatrix} \end{array} \qquad \text{Equation 2}$$

A reachability matrix R is a matrix including information about whether or not the nodes of graph G are interconnected and whether the direction is the nominal direction or reverse direction. A nominal reachability matrix $R_n$, which is a reachability matrix for the nominal-direction graph, has the form of an upper triangular matrix, as expressed in Equation 3. The nominal reachability matrix according to Equation 3 is a reachability matrix for the nominal-direction graph of the sub-track layout of FIG. 5.

$$R_n = \begin{array}{c} \\ C21 \\ C22 \\ P21A \\ C23 \\ P21B \\ C24 \\ C25 \end{array} \begin{array}{c} \begin{array}{ccccccc} C21 & C22 & P21A & C23 & P21B & C24 & C25 \end{array} \\ \begin{bmatrix} 0 & 0 & 0 & 0 & + & 0 & 0 \\ 0 & 0 & + & 0 & 0 & 0 & 0 \\ 0 & 0 & 0 & - & 0 & 0 & + \\ 0 & 0 & 0 & 0 & - & 0 & 0 \\ 0 & 0 & 0 & 0 & 0 & + & 0 \\ 0 & 0 & 0 & 0 & 0 & 0 & 0 \\ 0 & 0 & 0 & 0 & 0 & 0 & 0 \end{bmatrix} \end{array} \qquad \text{Equation 3}$$

A reverse reachability matrix $R_r$, which is a reachability matrix for the reverse-direction graph, has the form of a lower triangular matrix. The reverse reachability matrix according to Equation 4 is a reachability matrix for the reverse-direction graph of the sub-track layout of FIG. 5.

Equation 4

$$R_r = \begin{array}{c} \\ C21 \\ C22 \\ P21A \\ C23 \\ P21B \\ C24 \\ C25 \end{array} \begin{array}{c} \begin{array}{ccccccc} C21 & C22 & P21A & C23 & P21B & C24 & C25 \end{array} \\ \begin{bmatrix} 0 & 0 & 0 & 0 & 0 & 0 & 0 \\ 0 & 0 & 0 & 0 & 0 & 0 & 0 \\ 0 & + & 0 & 0 & 0 & 0 & 0 \\ 0 & 0 & - & 0 & 0 & 0 & 0 \\ 0 & 0 & 0 & - & 0 & 0 & 0 \\ 0 & 0 & 0 & 0 & + & 0 & 0 \\ 0 & 0 & + & 0 & 0 & 0 & 0 \end{bmatrix} \end{array}$$

The reachability matrices each includes character values as the elements of the matrix. The elements contained in the respective reachability matrices may be expressed as $r_{i,j}$. The reachability matrices may each be calculated by Equation 5. The reachability matrices $R_n$ and $R_r$ are as shown in Equation 3 and Equation 4.

Equation 5

$$R = [r_{i,j}] = \begin{cases} '+', G \text{ has a direct}\{k_i, k_j\}\text{path with normal switch direction} \\ '-', G \text{ has a direct}\{k_i, k_j\}\text{path with reverse switch direction} \\ '0', \text{otherwise} \end{cases}$$

The route of the train may be generated by an iterative multiplication operation between the initial routing matrix C and the reachability matrix R. In matrix multiplication, the result of the multiplication operation between two elements including '0 (zero value)' is 0. A multiplication operation between two non-zero elements means string concatenation. In graph G, the unit of movement between adjacent nodes may be defined as a hop. For example, two nodes are required to move one hop, and the number of nodes included in the k-th hop may be k+1.

A k-th path matrix $P_{n(k)}$, which is the path matrix of the k-th hop for the nominal-direction graph, may be calculated by the operation of Equation 6. The train-route generating apparatus repeats matrix multiplication until all elements of the k-th path matrix become 0.

Equation 6

$$P_{n(0)} = C$$

$$P_{n(1)} = CR_nC = CR_nP_{n(0)}$$

-continued $$P_{n(2)} = CR_nCR_nC = CR_nP_{n(1)}$$

$$\vdots$$

$$P_{n(k)} = CR_nP_{n(k-1)}$$

A nominal-direction routing matrix $P_n$ for the nominal-direction graph may be generated by summing the path matrix of the 0th hop through the path matrix of the k-th hop, that is, calculating $\Sigma_{k=1}P_{n(k)}$ A nominal-direction routing matrix for the sub-track layout of FIG. 5, which is generated based on Equations 2 to 6 is expressed as Equation 7.

Equation 7

$$P_n = \begin{array}{c} \\ C21 \\ C22 \\ P21A \\ C23 \\ P21B \\ C24 \\ C25 \end{array} \begin{array}{c} \begin{array}{ccccccc} C21 & C22 & P21A & C23 & P21B & C24 & C25 \end{array} \\ \begin{bmatrix} 0 & 0 & 0 & 0 & C21+P21B & C21+P21B+C24 & 0 \\ 0 & 0 & C22+P21A & C22+P21A+C23 & C22+P21A-C23-P21B & C22+P21A-C23-P21B+C24 & C22+P21A+C25 \\ 0 & 0 & 0 & P21A-C23 & P21A-C23-P21B & P21A-C23-P21B+C24 & P21A+C25 \\ 0 & 0 & 0 & 0 & C23-P21B & C23-P21B+C24 & 0 \\ 0 & 0 & 0 & 0 & 0 & P21B+C24 & 0 \\ 0 & 0 & 0 & 0 & 0 & 0 & 0 \\ 0 & 0 & 0 & 0 & 0 & 0 & 0 \end{bmatrix} \end{array}$$

A path matrix $P_{r(k)}$ of the k-th hop for the reverse-direction graph of the sub-track layout shown in FIG. 5 may be calculated by the operation of Equation 8. Accordingly, the path matrix of the k-th hop for reverse-direction graph Gr may be simply calculated by transposing the path matrix $P_{n(k)}$ of the k-th hop for the nominal-direction graph. The reverse-direction routing matrix $P_r$ for the reverse-direction graph Gr may be generated by summing the path matrices of the 0th through k-th hops, that is, calculating $\Sigma_{k=1}P_{r(k)}$.

Equation 8

$$P_{r(0)} = C = P_{n(0)}^T$$

$$P_{r(1)} = CR_rP_{r(0)} = (CR_nP_{n(0)})^T = P_{n(1)}^T$$

$$P_{r(2)} = CR_rP_{r(1)} = (CR_nP_{n(1)})^T = P_{n(2)}^T$$

$$\vdots$$

$$P_{r(k)} = CR_rP_{r(k-1)} = (CR_nP_{n(k-1)})^T = P_{n(k)}^T$$

The final routing matrix P for both the track layout shown in FIG. 5 and the graph G shown in FIG. 6A may be calculated by summing the nominal-direction routing matrix $P_n$ and the reverse-direction routing matrix $P_r$. The final routing matrix of the sub-track layout of FIG. 5 is as shown in Equation 9. In at least one embodiment, a route from an arbitrary node A to another node B among a plurality of nodes included in graph G is represented as P(A, B). As shown in Equation 9, a route P(C22, C24) from node C22 to node C24 may be expressed as [C22+P21A−C23−P21B+C24]. Here, the sign '+' placed between the respective nodes signifies a normal switch direction. The sign '−' placed between the respective nodes signifies a reverse switch direction. When passing class C22, the train travels in the normal switch direction, and when passing through point machine P21A, it travels in the reverse switch direction. When passing class C23, the train travels in the reverse switch direction, and when passing through point machine P21B, it travels in the normal switch direction. The train passes through C22, P21A, C23, and P21B to reach C24.

Equation 7

$$P = \begin{array}{c} \\ C21 \\ C22 \\ P21A \\ C23 \\ P21B \\ C24 \\ C25 \end{array} \begin{array}{c} \begin{array}{ccccccc} C21 & C22 & P21A & C23 & P21B & C24 & C25 \end{array} \\ \begin{bmatrix} 0 & 0 & 0 & 0 & C21+P21B & C21+P21B+C24 & 0 \\ 0 & 0 & C22+P21A & C22+P21A+C23 & C22+P21A-C23-P21B & C22+P21A-C23-P21B+C24 & C22+P21A+C25 \\ 0 & P21A-C22 & 0 & P21A-C23 & P21A-C23-P21B & P21A-C23-P21B+C24 & P21A+C25 \\ 0 & C23-P21A+C22 & C23-P21A & 0 & C23-P21B & C23-P21B+C24 & 0 \\ P21B+C21 & P21B-C23-P21A+C22 & P21B-C23-P21A & P21B-C23 & 0 & P21B+C24 & 0 \\ C24+P21B+C21 & C24+P21B-C23-P21A+C22 & C24+P21B-C23-P21A & C24+P21B-C23 & C24+P21B & 0 & 0 \\ 0 & C25+P21A+C22 & C25+P21A & 0 & 0 & 0 & 0 \end{bmatrix} \end{array}$$

In at least one embodiment, the train-route generating apparatus is responsive to new route information [C21–P21B–C24] received from a mission of the ATS system for calculating and generating a routing matrix $P_3$ corresponding to the third hop. The train-route generating apparatus compares the calculated route from the routing matrix with the received route information from the ATS system. With the route from class C21 to class C24 being [C21+P21B+C24] as shown in Equation 9, the train-route generating apparatus can verify the route by determining that there is an error happened to the received route. This allows the train-route generating apparatus to re-establish the correct route and thereby protect the train from dangerous situations. In another embodiment, the train-route generating apparatus operates as part of an onboard automatic train control system.

Figure 7:
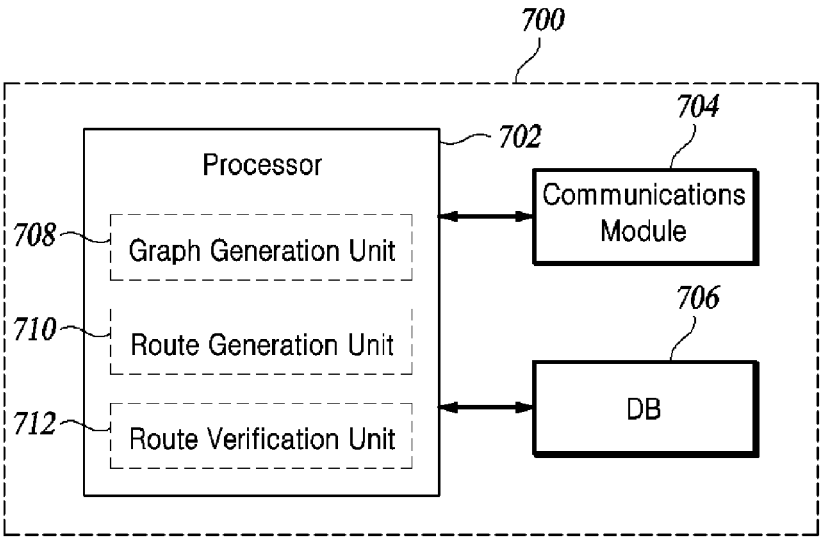
FIG. 7 is a block diagram of the respective components in the train-route generating apparatus according to at least one embodiment of the present disclosure.

FIG. 7 is a block diagram of the respective components in the train-route generating apparatus according to at least one embodiment of the present disclosure.

The train-route generating apparatus 700 according to at least one embodiment of the present disclosure includes all or some of a processor 702, a communication module 704, and a database (DB) 706. The train-route generating apparatus 700 shown in FIG. 7 is according to at least one embodiment, and all the blocks shown in FIG. 7 are not requisite components, some blocks included in the train-route generating apparatus 700 may be added, changed, or deleted in another embodiment. For example, the train-route generating apparatus 700 may further include a memory (not shown) for storing a program for causing the processor 702 to perform a train-route generating method according to at least one embodiment of the present disclosure. Here, the program may include a plurality of instructions executable by the processor 702, and the plurality of instructions when executed by the processor 702 allows a train route to be generated and verified. The memory may include at least one of a volatile memory and a non-volatile memory. The volatile memory includes static random access memory (SRAM) or dynamic random access memory (DRAM), and the non-volatile memory includes flash memory among others.

Hereinafter, the respective components included in the train-route generating apparatus 700 will be described by referring to FIG. 7.

The processor 702 may include at least one core capable of executing at least one or more instructions. The processor 702 may execute instructions stored in the memory, and it may perform generating a train route and verification by executing the instructions. In at least one embodiment of the present disclosure, the processor 702 includes all or some of a graph generation unit 708, a route generation unit 710, and a route verification unit 712. Here, the graph generation unit 708, the route generation unit 710, and the route verification unit 712 may have logical configurations.

The graph generation unit 708 generates a graph for the track layout by calling track information stored in the DB 706. Specifically, the graph generation unit 708 receives the train route from the mission of the ATS system and searches the DB 706 to call up the track information corresponding to the received train route. Detailed methods performed by the graph generation unit 708 for generating the graph for the sub-track layout, the nominal-direction graph, and the reverse-direction graph therefor are the same as those described above referring to FIGS. 4 to 6C, so reiterative details thereof will be omitted.

The graph generation unit 708 operates based on the graph for the sub-track layout, the nominal-direction graph, and the reverse-direction graph therefor, for generating a node matrix, a reachability matrix, and an initial routing matrix according to Equations 1 to 5. The detailed illustrative operation of the graph generation unit 708 for generating a node matrix, a reachability matrix, and an initial routing matrix for the sub-track layout shown in FIG. 5 is the same as that described above referring to Equations 1 to 5, so reiterative details thereof will be omitted.

The route generation unit 710 operates based on a plurality of graphs and a plurality of matrices for the graphs generated by the graph generation unit 708, for constructing a path matrix and a routing matrix according to Equations 6 to 9 and thereby generates a train route. The detailed illustrative operation of the route generation unit 710 for generating a routing matrix for the sub-track layout shown in FIG. 5 is the same as that described above referring to Equations 6 to 9, so reiterative details thereof will be omitted.

The route verification unit 712 compares the train route generated by the route generation unit 710 with the route received from the ATS system and thereby verifies the accuracy and safety of the track switching directions of the point machines located in the train route. In a moving block environment, an occurrence of error in the switching direction made by a point machine in a train route could cause a catastrophic result including train derailment, collision, and rear-ending. To resolve this matter, the route verification unit 712 verifies the train route by verifying the integrity of the switching directions of the point machines located on the route generated by the route generation unit 710 to verify the route of the train.

Figure 8:
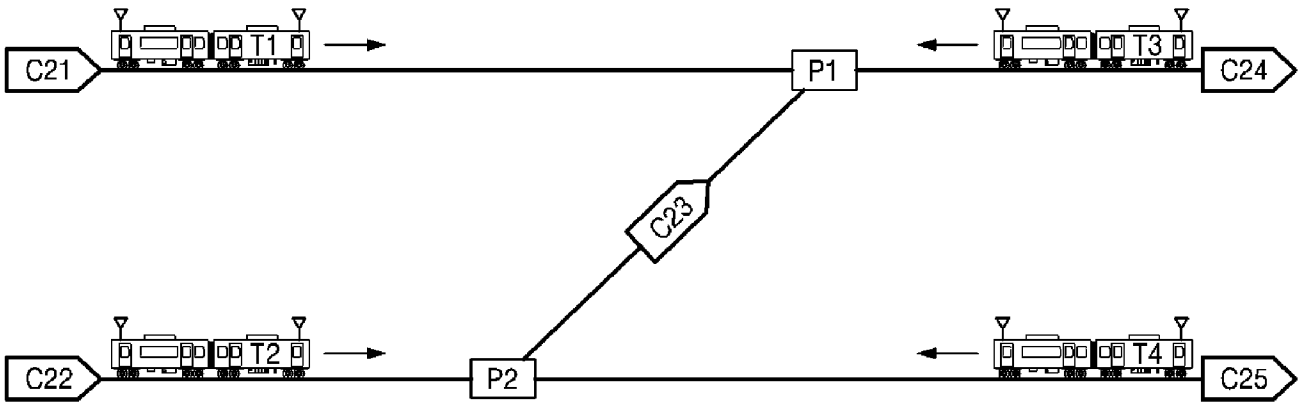
FIG. 8 illustrates a dangerous-side route in the switching area in relation to the process of verifying a train route by the train-route generating apparatus according to at least one embodiment of the present disclosure.

FIG. 8 illustrates a dangerous-side route in the switching area in relation to the process of verifying a train route by the train-route generating apparatus according to at least one embodiment of the present disclosure.

The following refers to FIG. 8 for describing an illustrative verification process performed by the route verification unit 712 on the train route generated with respect to the track layout of Gyeryong Station on the Honam Line in the Republic of Korea shown in FIG. 5.

In at least one embodiment of the present disclosure, the train-route generating apparatus 700 generates an entrance and exit route for left-area nodes including class C28 through class C33 and their leftside nodes shown in the track layout of FIG. 5. Nodes for generating the entrance and exit route include classes C21 to C33, point machines P21A, P21B, and point machines P22 to P25. According to the method presented in Equation 1, node matrix K for the left-area nodes generated by the route generation unit 710 may be expressed as Equation 10.

$$K = [C21\ C22\ P21A\ C23\ P21B\ C24\ C2S\ P23\ P22\ C26\ C27\ P25\ P24\ C28\ C29\ C30\ C31\ C32\ C33] \quad \text{Equation 10}$$

According to the method described above referring to Equation 2, initial routing matrix C for the left-area nodes generated by the route generation unit 710 may be expressed as Equation 11 as shown in FIG. 11.

According to the methods described above referring to Equation 3 and Equation 4, nominal reachability matrix $R_n$ and reverse reachability matrix $R_r$ for the left-area nodes generated by the route generation unit 710 may be expressed as Equation 12 and Equation 13, respectively. Equation 12 and Equation 13 are shown in FIGS. 12 and 13, respectively.

FIGS. 9A, 9B, 9C, and 9D illustrate final routing matrices generated by the train-route generating apparatus according to at least one embodiment of the present disclosure.

As shown in FIGS. 9A to 9D, final routing matrix P is generated by the route generation unit 710 for a left-area graph according to the methods described above with Equations 6 to 9. FIGS. 9A to 9D show some of the final routing matrix for the entire graph in consideration of convenience of illustration, and the final routing matrix includes all cases of entrance and exit routes that can be generated between the left-area nodes.

As show in FIG. 8, trains T1 and T2 are traveling along the classes in ascending order of the class numbers. Trains T3 and T4 are traveling along the classes in descending order of the class numbers. Here, first to fourth dangerous-side routes may be defined as being dangerous-side routes for trains T1 to T4 when an error occurs in the switching direction of a point machine. For example, the first dangerous-side route may be defined by [C21+P1+C24] that is a route generated for train T1 with point machine P1 assuming the track switching direction that is in the reverse mode. As with the nominal-direction graph shown in FIG. 6B, train T1 could reach class C24 from class C21 if point machine P1 were in the normal mode. However, since point machine P1 is presently in the reverse mode, train T1 is unable to reach class C24 and will derail. The second dangerous-side route may be defined by [C22+P2−C23−P1+C24] that is a route generated for train T2 with point machine P1 assuming the track switching direction that is in the normal mode. As with the nominal-direction graph shown in FIG. 6B, train T2 could reach class C24 from class C23 if point machine P1 were in the reverse mode. However, since the point machine P1 is presently in the normal mode, train T2 is unable to reach class C24 and will derail. The third dangerous-side route may be defined by [C24+P1−C23−P2+C22] that is a route generated for train T3 with point machine P2 assuming the track switching direction that is in the normal mode. As with the reverse-direction graph shown in FIG. 6C, train T3 could reach class C22 from class C23 if point machine P2 were in the reverse mode. However, since point machine P2 is presently in the normal mode, the train T3 is unable to reach class C22 and will derail. The fourth dangerous-side route may be defined by [C25+P2+C22] that is a route generated for train T4 with point machine P2 assuming the track switching direction that is in the reverse mode. As with the reverse-direction graph shown in FIG. 6C, train T4 could reach class C22 from class C25 if point machine P2 were in the normal mode. However, with point machine P2 being in the reverse mode, train T4 is unable to reach class C22 and will derail.

In the final routing matrix for the left-area nodes according to FIGS. 9A to 9D, all cases of entrance and exit routes generated by the route generation unit 710 and extending from class C21 or class C22 to class C28 through class C33 can be listed as in Table 1. Here, class C21 or C22 is a node located at the left end of the track layout shown in FIG. 5. Classes C28 through C33 correspond to station dwell points of the track layout.

TABLE 1

| Route Name | Route | Length (hops) | Direction |
|---|---|---|---|
| P(C21, C28) | C21 + P21B + C24 + P23 − C26 + P25 − C28 | 6 | Nominal |
| P(C21, C29) | C21 + P21B + C24 + P23 − C26 + P25 + C29 | 6 | Nominal |
| P(C21, C30) | C21 + P21B + C24 + P23 + C30 | 4 | Nominal |
| P(C22, C28) | C22 + P21A − C23 − P21B + C24 + P23 − C26 + P25 − C28 | 8 | Nominal |

TABLE 1-continued

| Route Name | Route | Length (hops) | Direction |
|---|---|---|---|
| P(C22, C29) | C22 + P21A − C23 − P21B + C24 + P23 − C26 + P25 + C29 | 8 | Nominal |
| P(C22, C30) | C22 + P21A − C23 + P21B + C24 + P23 + C30 | 6 | Nominal |
| P(C22, C31) | C22 + P21A + C25 + P22 + C31 | 4 | Nominal |
| P(C22, C32) | C22 + P21A + C25 + P22 − C27 + P24 + C32 | 6 | Nominal |
| P(C22, C33) | C22 + P21A + C25 + P22 + C27 + P24 − C33 | 6 | Nominal |
| P(C28, C21) | C28 − P25 + C26 − P23 + C24 + P21B + C21 | 6 | Reverse |
| P(C28, C22) | C28 − P25 + C26 − P23 + C24 + P21B − C23 − P21A + C22 | 8 | Reverse |
| P(C29, C21) | C29 + P25 + C26 − P23 + C24 + P21B + C21 | 6 | Reverse |
| P(C29, C22) | C29 + P25 + C26 − P23 + C24 + P21B − C23 − P21A + C22 | 8 | Reverse |
| P(C30, C21) | C30 + P23 + C24 + P21B + C21 | 4 | Reverse |
| P(C30, C22) | C30 + P23 + C24 + P21B − C23 − P21A + C22 | 6 | Reverse |
| P(C22, C31) | C31 + P22 + C25 + P21A + C22 | 4 | Reverse |
| P(C32, C22) | C32 + P24 + C27 − P22 + C25 + P21A + C22 | 6 | Reverse |
| P(C33, C22) | C33 − P24 + C27 − P22 + C25 + P21A + C22 | 6 | Reverse |

When the train-route generating apparatus 700 receives the train route information corresponding to [C21−P21B+C24+P23+C30] from the mission of the ATS system, the route verification unit 712 searches Table 1 to output route P(C21, C30) in the third line. Since the path included in route P(C21, C30) is defined as [C21+P21B+C24+P23+C30], the route verification unit 712 determines that an error has occurred in the switching direction of the point machine P21B. For example, the route verification unit 712 verifies that the train if traveling on the track following the received route information runs into a dangerous situation that is any one of train derailment, collision, and rear-ending. Meanwhile, upon determining that the track switching direction of the point machine is accurate and safe, the route verification unit 712 may output the route received from the ATS system as the final route. The route verification unit 712 may transmit the final route to the ATS system through the communication module 704. Accordingly, the train-route generating apparatus 700 according to at least one embodiment of the present disclosure can confirm in advance whether the track switching direction of the point machine located in the train route is safe, thereby providing protection against the dangerous-side path.

A communication module 704 is linked with the processor 702 to provide access to an external network. For example, the train-route generating apparatus 700 may perform communications with other devices, such as a ground device or an on-board device, through the communication module 704. The communication module 704 may include, for example, all or some of a transmit filter, a receive filter, an amplifier, a mixer, an oscillator, a digital to analog converter (DAC) and an analog to digital converter (ADC), etc.

The DB 706 may be a database of track layouts of routes. The DB 706 may include, for example, facilities expressed by IDs of all balises (or Tags) installed on the route and a balise reference coordinate system (ETCS SRS-subset 026). Here, the facilities include point machines, boarding and alighting platforms, crossing gates, and platform screen doors (PSDs). For example, the starting point and the ending point of the boarding and alighting platform may each be expressed by an offset, which is an integer variable, according to a displacement from a particular balise ID on the track.

Figure 10:
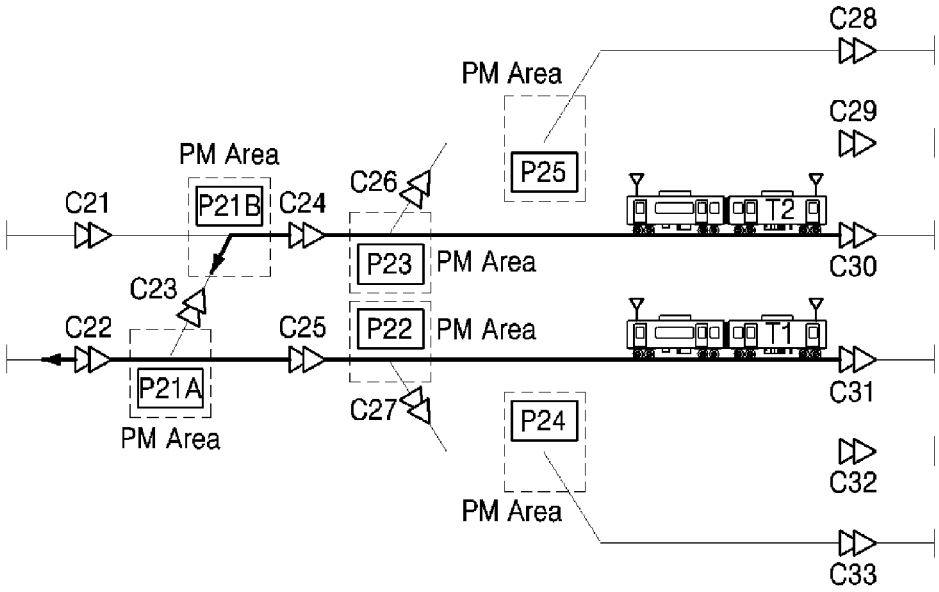
FIG. 10 is a diagram illustrating an example resource allocation for a plurality of trains headed to the same class from different classes by the train-route generating apparatus according to at least one embodiment.

FIG. 10 is a diagram illustrating an example resource allocation for a plurality of trains headed to the same class from different classes by the train-route generating apparatus according to at least one embodiment.

FIG. 10 assumes that trains T1 and T2 that have stopped at classes C31 and C30 are about to advance toward class C22. In at least one embodiment, train T1 is ahead of train T2 in securing the movement authority for the resource up to class C22. In particular, the train-route generating apparatus mounted on train T1 calls up route P(C30, C22) and then exclusively locks at least one point machine located between class C31 and class C22. Train T1 is able to move from class C31 to class C22 based on the secured resources. Train T2 is to verify the route from class C30 to class C2 by searching Table 1 to call up route P(C30, C22) and searching for a limit point where Train T2 may collide with train T1 running on route. In particular, the train-route generating apparatus mounted on the train T2 secures the resources up to class C23, which is the limit point of the resource limited by the train T1. For example, train T2 locks at least one point machine located between class C30 and class C23, and it can only move from class C30 to class C23.

Figure 2:
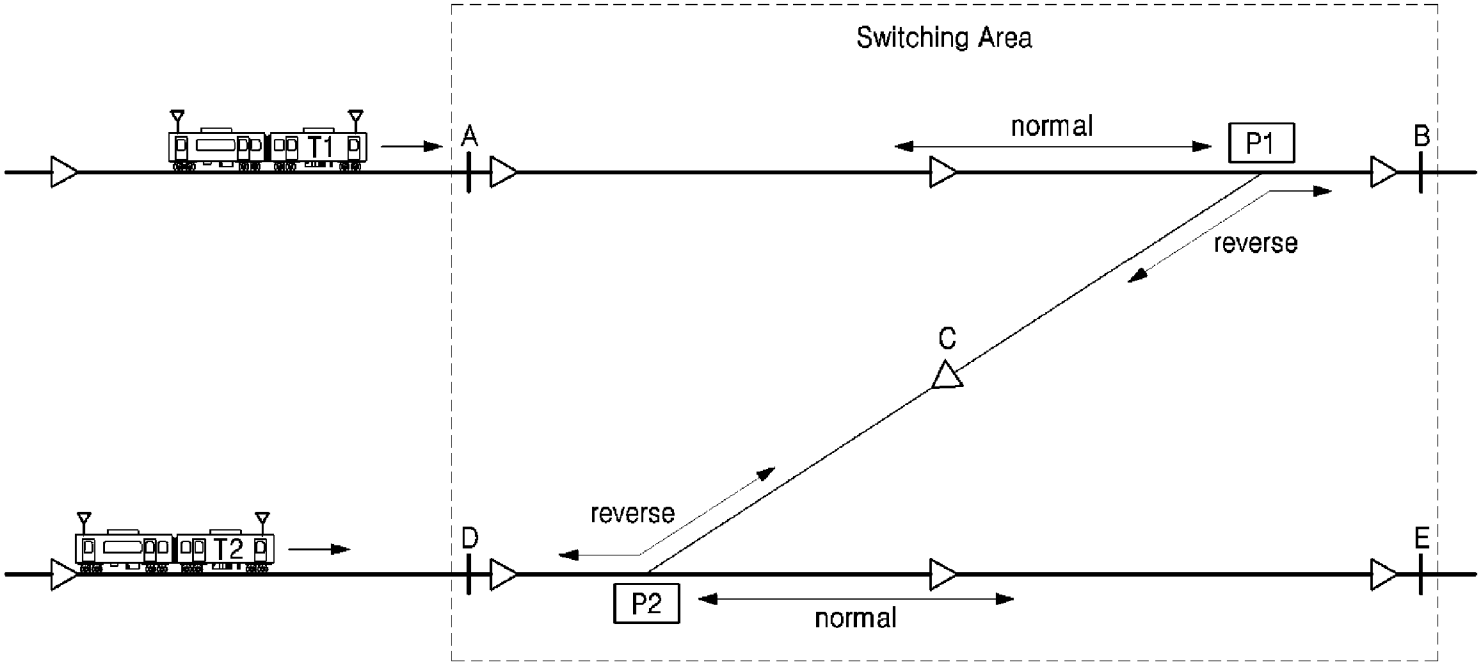
FIG. 2 (Prior Art)
FIG. 2 illustrates an interlocking logic of conventional CBTC.
Figure 3:
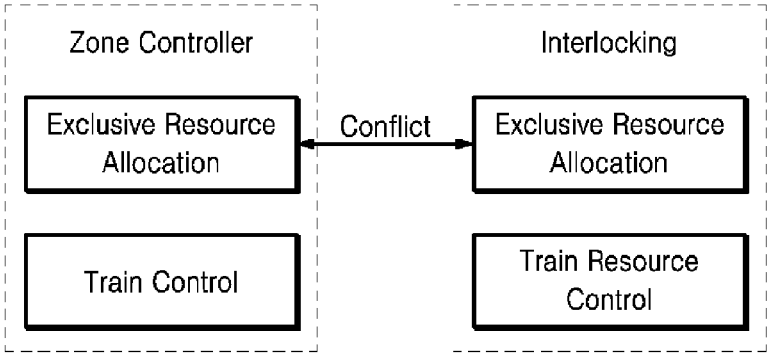
FIG. 3 (Prior Art)
FIG. 3 illustrates a conflict between the conventional interlocking and a zone controller by the exclusive resource allocation functions.

When compared to the conventional interlocking system of CBTC shown in FIG. 2, the interlocking logic included in the provided train-route generating apparatus 700 of the present disclosure can efficiently manage resources in the switching area by using the characteristics of the moving block environment.

Therefore, the interlocking function included in the train-route generating apparatus 700 of the present disclosure performs verification on the directions of routes, and allows the existing train on a route to have overlapping routes, thereby maximizing the benefits of the moving block principle.

Various implementations of the systems and methods described herein may be realized by digital electronic circuitry, integrated circuits, field-programmable gate arrays (FPGAs), application-specific integrated circuits (ASICs), computer hardware, firmware, software, and/or their combination. These various implementations can include those realized in one or more computer programs executable on a programmable system. The programmable system includes at least one programmable processor coupled to receive and transmit data and instructions from and to a storage system, at least one input device, and at least one output device, wherein the programmable processor may be a special-purpose processor or a general-purpose processor. Computer programs, which are also known as programs, software, software applications, or codes, contain instructions for a programmable processor and are stored in a "computer-readable recording medium."

The computer-readable recording medium includes any types of recording device on which data that can be read by a computer system are recordable. Examples of computer-readable recording medium include non-volatile or non-transitory media such as a ROM, CD-ROM, magnetic tape, floppy disk, memory card, hard disk, optical/magnetic disk, storage devices, and the like. The computer-readable recording medium further includes transitory media such as data transmission medium. Further, the computer-readable recording medium can be distributed in computer systems connected via a network, wherein the computer-readable codes can be stored and executed in a distributed mode.

Various implementations of the systems and techniques described herein can be realized by a programmable computer. Here, the computer includes a programmable processor, a data storage system (including volatile memory, nonvolatile memory, or any other type of storage system or a combination thereof), and at least one communication interface. For example, the programmable computer may be one of a server, network equipment, a set-top box, an embedded device, a computer expansion module, a personal computer, a laptop, a personal data assistant (PDA), a cloud computing system, and a mobile device.

Although exemplary embodiments of the present disclosure have been described for illustrative purposes, those skilled in the art will appreciate that various modifications, additions, and substitutions are possible, without departing from the idea and scope of the claimed invention. Therefore, exemplary embodiments of the present disclosure have been described for the sake of brevity and clarity. The scope of the technical idea of the embodiments of the present disclosure is not limited by the illustrations. Accordingly, one of ordinary skill would understand the scope of the claimed invention is not to be limited by the above explicitly described embodiments but by the claims and equivalents thereof.

REFERENCE NUMERALS

| | |
|---|---|
| 700: train-route generating apparatus | 702: processor |
| 704: communication module | 706: DB |
| 708: graph generation unit | 710: route generation unit |
| 712: route verification unit | |

The invention claimed is:

1. A method for generating a train route for railway signaling based on moving block principle, the method comprising:

generating a directed graph for a track layout by calling pre-stored track information;

generating a path matrix corresponding to a number of movement hops of a train based on the directed graph, and generating the train route from the path matrix; and verifying the train route by obtaining route information of the train from a mission of an automatic train supervision (ATS) system and comparing the route information with the train route, wherein the directed graph comprises:

nodes defined by at least one point machine (PM) and classes located on the track layout; and edges defined by tracks located between adjacent nodes among the nodes, and wherein the generating of the directed graph further comprises:

generating a node matrix for the nodes by traversing the directed graph in a zigzag direction;

generating an initial routing matrix by multiplying the node matrix by an identity matrix; and generating a reachability matrix based on whether any of the nodes are interconnected and whether the classes are in ascending order.

2. The method of claim 1, wherein the classes include a plurality of adjacent balises on the track layout.

3. The method of claim 1, wherein the directed graph comprises:

a nominal-direction graph for expressing a train route of the train when traveling along the classes in ascending order; and a reverse-direction graph for expressing a train route of the train when traveling along the classes in descending order.

4. The method of claim 3, wherein the reachability matrix comprises:

a nominal reachability matrix that is a reachability matrix for the nominal-direction graph; and a reverse reachability matrix that is a reachability matrix for the reverse-direction graph.

5. The method of claim 4, wherein the generating of the train route further comprises:

generating a path matrix for the nominal-direction graph by performing iterative multiplication between the initial routing matrix of the nominal-direction graph and the nominal reachability matrix, and calculating a k-th path matrix by performing iterative matrix multiplication until all elements included in the path matrix become 0;

calculating a nominal-direction routing matrix that is an entire path matrix for the nominal-direction graph by summing up to the k-th path matrix from a 0th path matrix that is the path matrix of the 0th hop for the nominal-direction graph;

calculating a reverse-direction routing matrix that is an entire path matrix for the reverse-direction graph by transposing the 0th to k-th path matrices for the nominal-direction graph; and generating a final routing matrix for the track layout by summing the nominal-direction routing matrix and the reverse-direction routing matrix.

6. The method of claim 5, wherein the verifying of the train route comprises:

extracting a route of the train corresponding to the route information by searching the final routing matrix, and verifying whether switching directions of the at least one point machine each match the route information.

7. The method of claim 6, wherein the verifying the train route further comprises:

transmitting a train route verification result obtained from the verifying to the ATS system.

8. An apparatus for generating a train route, comprising:

a database;

a communication module; and a processor configured to:

generate a directed graph for a track layout by calling pre-stored track information, generate a path matrix corresponding to a number of movement hops of a train based on the directed graph, and generate the train route from the path matrix, and verify the train route by obtaining route information of the train from a mission of an automatic train supervision (ATS) system and comparing the route information with the train route, wherein the directed graph comprises:

nodes defined by at least one point machine (PM) and classes located on the track layout; and edges defined by tracks located between adjacent nodes among the nodes, and wherein the processor is further configured to:

generate a node matrix for the nodes by traversing the directed graph in a zigzag direction;

generate an initial routing matrix by multiplying the node matrix by an identity matrix; and generate a reachability matrix based on whether any of the nodes are interconnected and whether the classes are in ascending order.

9. A non-transitory computer readable medium comprising computer instructions that are configured to, when executed by at least one processor, perform the method of claim 1.

10. A method for generating a train route for railway signaling based on moving block principle, the method comprising:

generating a directed graph for a track layout by calling pre-stored track information;

generating a path matrix corresponding to a number of movement hops of a train based on the directed graph, and generating the train route from the path matrix; and verifying the train route by obtaining route information of the train from a mission of an automatic train supervision (ATS) system and comparing the route information with the train route, wherein the verifying comprises verifying whether a route switching direction of the train route matches a route switching direction of the route information.

* * * * *